United States Patent [19]

Lin

[11] Patent Number: 4,611,356

[45] Date of Patent: Sep. 16, 1986

[54] FLUSHING APPARATUS FOR URINALS

[75] Inventor: Yeh-Huong Lin, I Lan Hsien, Taiwan

[73] Assignee: Hocheng Pottery Mfg. Co., Ltd., Taipei, Taiwan

[21] Appl. No.: 721,953

[22] Filed: Apr. 11, 1985

[51] Int. Cl.[4] ..... E03D 13/00; F16K 31/06

[52] U.S. Cl. ..... 4/301; 251/30.01

[58] Field of Search ..... 4/301-305, 4/DIG. 3; 137/599; 251/30, 322, 323

[56] References Cited

U.S. PATENT DOCUMENTS

| | | | |
|---|---|---|---|
| 2,764,324 | 9/1956 | Landreth | 251/322 |
| 2,940,722 | 6/1960 | Vargo | 251/30 |
| 3,630,482 | 12/1971 | Beller | 251/30 |
| 3,989,222 | 11/1976 | Yoshiyasu | 251/30 |
| 4,295,631 | 10/1981 | Allen | 251/30 |
| 4,309,781 | 1/1982 | Lissau | 4/304 |

FOREIGN PATENT DOCUMENTS

| | | | |
|---|---|---|---|
| 227598 | 9/1959 | Australia | 251/30 |
| 52-4635 | 1/1977 | Japan | 4/DIG. 3 |
| 57-6175 | 1/1982 | Japan | 251/30 |
| 57-6174 | 1/1982 | Japan | 251/30 |

*Primary Examiner*—Stephen Marcus
*Assistant Examiner*—L. J. Peters
*Attorney, Agent, or Firm*—Cushman, Darby and Cushman

[57] ABSTRACT

A flushing apparatus for urinals comprises: a housing including a first passage and a second passage adapted to communicate with the flush pipe; an automatic flush device including an electromagnetic valve having a valve stem biased by a first spring, a pressure sensing film provided with a pressure releasing hole and a ring flange, having at least one pressure balancing hole, and mounted below said valve stem with said pressure releasing hole adjoined beneath said valve stem; and a manual flush device having a manual button, a push rod, and a stop valve; whereby, automatic and manual flush operations will be effected without incurring any error action.

2 Claims, 4 Drawing Figures

FIG. 1A
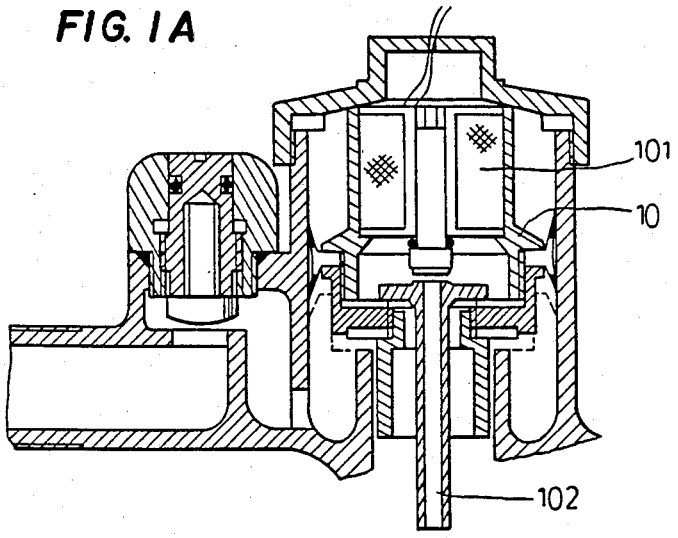
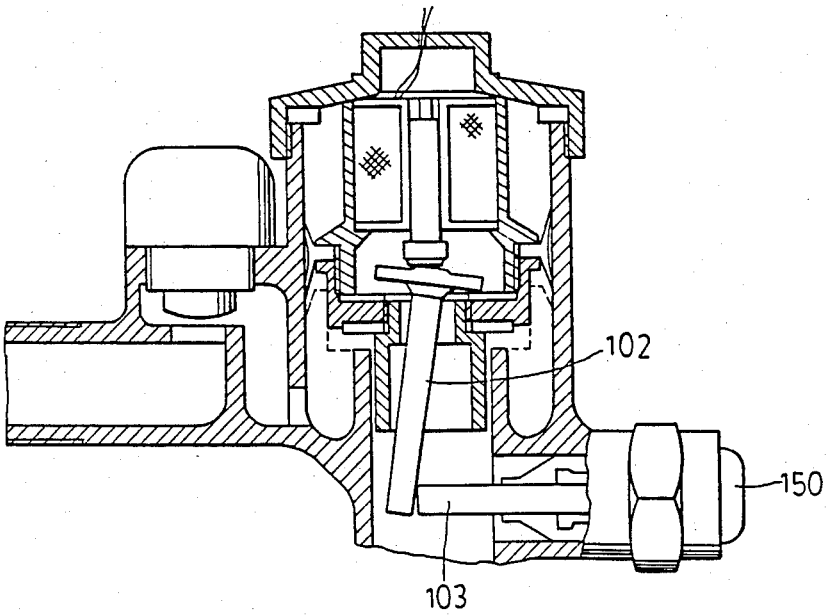
FIG.1 PRIOR ART

FLUSHING APPARATUS FOR URINALS

BACKGROUND OF THE INVENTION

This invention relates to a flushing apparatus for urinals, and paricularly to that type of flushing apparatus having an automatic flush device controlled by an infrared emitting-and-detecting control device and so arranged that a fixed flushing operation will be automatically effected, and a manual flush device which a user operates by pushing a manual button.

At present, the conventional flushing apparatus for man's stall urinal is confined to the following three types:

(1) The manual type uses the hand to press the flushing valve fixed on the water pipe thereof for activating the flushing operation. The problems of this type are (1) if the water pressure is low, flushing cannot be accomplished therewith; (2) most users usually either forget to flush or do not know how to use it; (3) it is easily contaminated with contagious diseases through hand operation.

(2) The timing type uses a timer to open and close a water valve for a time-fixed flushing operation. The problems of this type are: it is ineffective to keep the urinal clean because of the fixed time interval; and it consumes too much water during the time the urinal is not used at all.

(3) The automatic flushing type uses supersonic or infrared devices to effect the flushing operation. In the supersonic type, error actions often occur in the flushing operation since the stall urinals are installed in a public lavatory with close array, which is susceptible to erroneous sound reflection and causes error operation. The infrared type may result in a more reliable flushing operation, and there are some associated products thereof on the market. A related discussion of the development of the infrared-type flushing apparatus is provided in R.O.C. Patent No. 19708, issued on Oct. 6, 1983, to Mr. Lin. The operation of the patented evice is similar to that of the present invention, but has a different structure. A portion of the above mentioned No. 19708 is incorporated by reference.

Referring to FIG. 1, No. 19708 provides a floating piston 10 provided with an electromagnetic valve 101 controlled by an infrared control device which is not shown, swinging pole 102, passages for the water flow, and a manual button 103. The problems of such an apparatus are that there are many elements and passages located in the floating piston 10, so that long life of the piston and reliability of the flushing operation are doubtful. Take for example the way in which the power of the electromagnetic valve is connected, and the requirement of water-tightness. The large volume of the floating piston may influence the sensitivity and assurance of the operation thereof caused by water pressure. Because the swinging pole has two operation functions, including automatic and manual control, which may interfere with each other, when the swinging pole cannot return to its initial position after being displaced by the manual button, water will continuously drain out, and this will affect the operation of the electromagnetic valve thereafter. When the electromagnetic valve is damaged, the operation of the manual button will also be affected, and if there are no new parts for immediate supply, all functions of the flushing apparatus will be lost, including the manual operation.

SUMMARY OF THE INVENTION

It is accordingly a primary objective of this invention to provide an automatic flushing mechanism, which improves the known flushing apparatus and overcomes the problems associated with the prior art, to effect a flushing operation operated by a single pressure sensing film, which can be sensitively and reliably activated.

It is an another object of this invention to provide a manual flushing mechanism which is independently mounted with regard to the automatic flushing mechanism so they do not interfere with each other.

It is a further object of this invention to provide an automatic flushing apparatus which has an electromagnetic valve located out of the main flushing configuration for assuring the life of the elements and which is easy to exchange if malfunctioning without affecting the flushing operation.

With the above and other objectives in mind, the present invention provides a flushing apparatus for urinals which comprises: a housing adapted to communicate with the flush pipe; an automatic flush device having an electromagnetic valve mounted to the outer-and-upper side of said housing with a valve stem vertically mounted in said electromagnetic valve and biased by a spring and adapted to be controlled by an infrared emitting-and-detecting control device mounted outside of said housing, and a pressure sensing film mounted below said valve stem; and a manual flush device including a manual button biased by an another spring, a push rod pivotally mounted to the manual button, and a stop valve attached to the end of the push rod and independently mounted in said housing with regard to said automatic flush device, so that the automatic flushing operation will be effected by an activation signal from said infrared control device and the manual flushing operation will be effected if a user pushed said manual button without incurring any error action.

BRIEF DESCRIPTION OF THE DRAWINGS

These advantages and other features of the present invention will become clear from the following detailed description of a preferred embodiment taken in connection with the accompanying drawings which form an integral part of this application and in which:

FIG. 1 is a schematically sectional view showing the operations of a known flushing mechanism;

DETAILED DESCRIPTION OF THE PREFERRED EMBODIMENT

Figure 2:
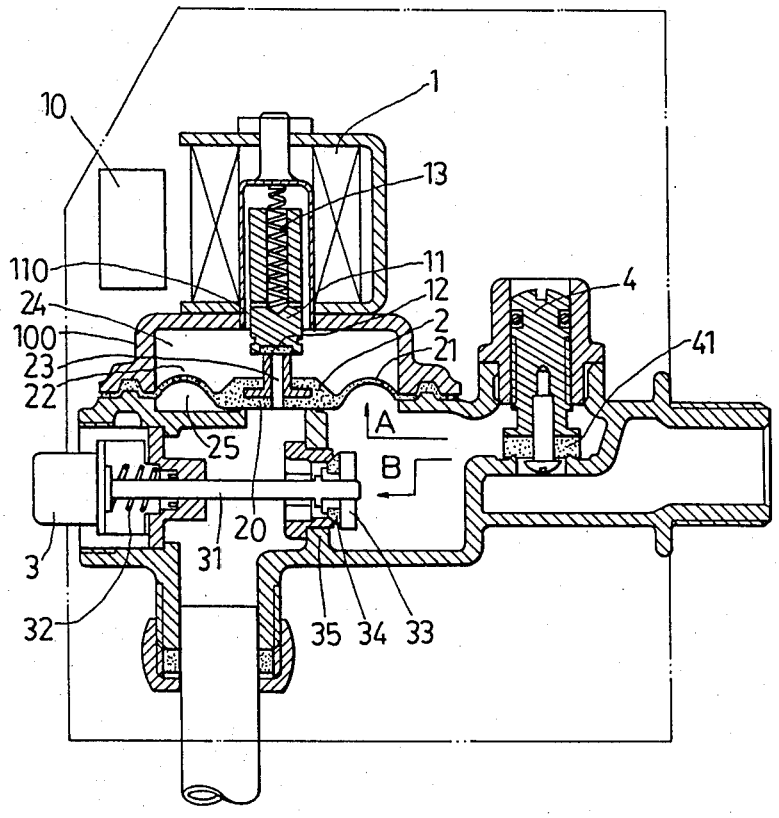
FIG. 2 is a schematically sectional view of a preferred embodiment of the present invention.

Referring now to the drawings, it should be noted that a like member is designated with a like reference number. In FIG. 2, there is a control circuit 10 which is a prior known and used infrared photoelectric induction circuit, and which has been extensively applied to many simple automatic control devices, such as automatic doors, and burgular alarms, and so on, and the known operational principle, details of the art, and circuit thereof do not need to be mentioned hereinafter. A preferred embodiment of a flushing apparatus for urinals according to this invention is shown in FIG. 2, which apparatus comprises: a housing 100 adapted to be fixed over the water pipe at the top area of a stall urinal, including a first passage A defining a first flush hole 51 (shown in FIG. 3) and a second passage B defining a second flush hole 52 (shown in FIG. 4) in an inner wall 35 of said housing 100 adapted to communicate with the flush pipe and provided with a bore 110 in the upper side of said housing 100; an automatic flush device including an electromagnetic valve 1, mounted to the outer-and-upper side of said housing 100 with a valve stem 11 vertically mounted in said electromagnetic valve 1 and having a sealing gasket 12 on the lower end thereof and a first spring 13 located in a rear portion thereof to bias said valve stem 11 to extend through said bore 110 into said housing 100 and adapted to be controlled by said infrared control device 10, and a pressure sensing film 2 having a central level portion 20, a pressure releasing hole 23 at the center of said central level portion 20, and a ring flange about said central level portion 20 provided with at least one pressure balancing hole 22 therein, which diameter is smaller than that of said pressure releasing hole 23, mounted below said valve stem 11 in said first passage A so that said pressure releasing hole 23 normally adjoins the underside of said valve stem 11, and separates the space within said first passage A into an upper film chamber 24 and a lower flange chamber 25 which are filled with water therein, with said central level portion 20 of said pressure sensing film 2 tightly covering said first flush hole 51; a manual flush device including a manual button 3 mounted in the outer wall of said housing 100 so that the head portion thereof protrudes out of said housing 100 for operating and is provided with a second spring 32 adapted to replace said manual button 3 after pressed, a push rod 31 pivotally jointed with said manual button 3 and forwardly extended through said second flush hole 52 in said inner wall 35 of said housing 100, which diameter is larger than that of said push rod 31, to its end, and a stop valve 33, which diameter is larger than that of said second flush hole 52, mounted to the end of said push rod 31 so as to tightly adjoin said second flush hole 52 and provided with a sealing gasket 34 between said stop valve 33 and said second flush hole 52; and a water regulating element 4 mounted within said housing 100 for regulating the water flow flowing through said first and second passages A, B, and provided with a sealing gasket 41 on the bottom end thereof.

Figure 3:
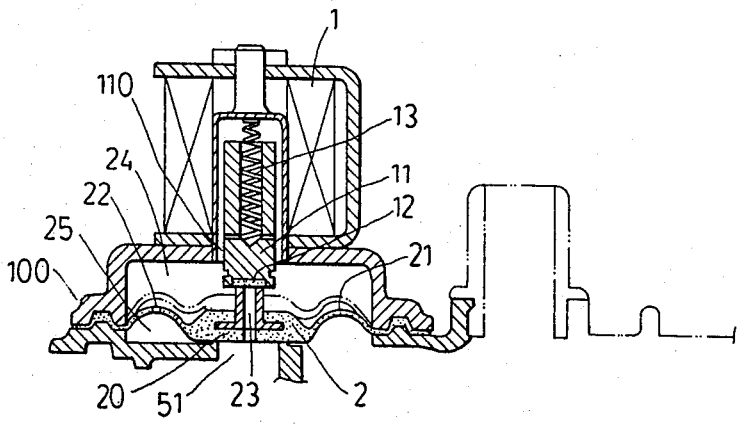
FIG. 3 is a schematically sectional view of a part of the automatic flush device of the preferred embodiment of the present invention.

Referring to FIG. 3, when electromagnetic valve 1 is not actuated, the valve stem 11 closes the pressure releasing hole 23 of the pressure sensing film 2 for watertightness of said first flush hole 51 by said first spring 13 and the water pressure. The film chamber 24 and flange chamber 25 divided by the pressure sensing film 2 interpenetrate with each other by way of the pressure balancing hole 22 and balance the water pressures therein. Because the pressured area of said pressure sensing film 2 in the film chamber 24 is far larger than that in the flange chamber 25, the pressure sensing film 2 will tightly close the first flush hole 51 as a result of the force of the spring 13 enhanced by the water pressure to prevent the film 2 from floating by virtue of the strong pressure of water feed.

When electromagnetic valve 1 is activated by said infrared control device 10 and overcomes the elasticity of first spring 13 to raise valve stem 11 to leave pressure releasing hole 23 open, the water held in the upper film chamber 24 will rapidly drain off through the pressure releasing hole 23, and the water pressure in film chamber 24 decreases. Now, because flange chamber 25 directly interpenetrates with the pipe of the water service, the water pressure in flange chamber 25 will be far larger than that in film chamber 24 and will force the pressure sensing film 2 to be raised to open the first flush hole 51 and flush the urinal. In this way, because pressure releasing hole 23 is larger than pressure balancing hole 22, the operation of releasing the water pressure in film chamber 24 is sensitive and reliable.

When said infrared control device 10 releases the electromagnetic valve 1, valve stem 11 closes pressure releasing hole 23 with sealing gasket 12 by the activation of spring 13. At this time, film chamber 24 still communicates with flange chamber 25 through pressure balancing hole 22, that is, communicates with the pipe of the water service. After the pressures in the film chamber and the flange chamber reach to a balance through a suitable balancing period, the length of which is determinative by the dimension of pressure balancing hole 22, pressure sensing film 2 closes the first flush hole 51 to stop the water by the activation of spring 11 and the differential water pressure.

Figure 4:
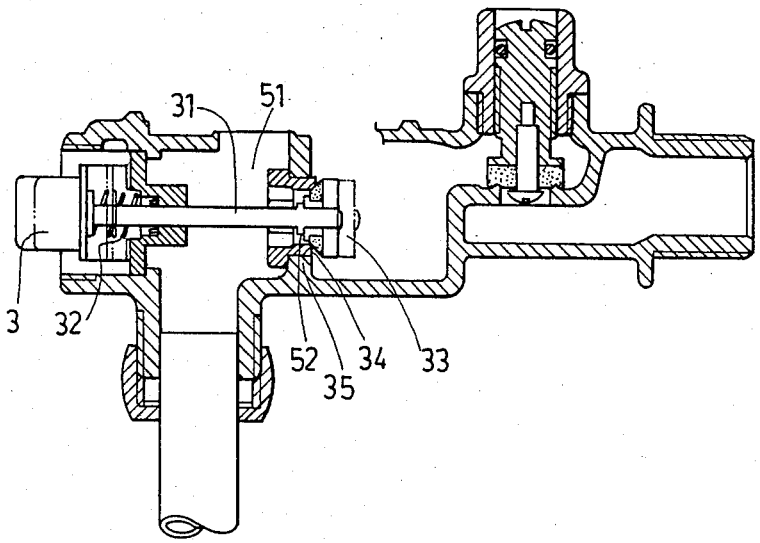
FIG. 4 is a schematically sectional view of a part of the manual flush device of the preferred embodiment of the present invention.

Now referring to FIG. 4, if the infrared control device 10 or the automatic flush device fails to operate, or the electric source disconnects, a user may merely push the manual button 3 to displace the stop valve 33 to open the second flush hole 52 and flush the urinal.

The water regulating element 4 may be a screwed valve or the like.

The foregoing is related to the configuration and the principle of operation of a preferred embodiment in accordance with the present invention, and does not mention the controlling and regulation of the delay-action time of the infrared control device and the flushing periods, which are appreciated by those skilled in the art.

While a preferred embodiment has been illustrated and described, it is to be understood by those skilled in the art that various changes and modifications can be made therein without departing from the spirit and scope of this invention as being defined in the appended claims.

What I claim is:

1. A flushing apparatus for urinals having a dual flushing actuating capability comprising:

a flush pipe;

a housing having an upper side, an inner wall and a bore in said upper side, said housing including:

a first passage, a first flush defined by said first passage, hole a second passage, a second flush hole defined by said second passage, in said inner wall, said first passage and said second passage operatively communicating with said flush pipe;

said housing including water regulating means for regulating the water flow flowing through said first passage and second passage;

a manual flush device including:

a button, said button mounted in said housing so that a portion of said button protrudes outwardly of said housing;

means for biasing said button so that a portion of said button protrudes outwardly of said housing;

a push rod pivotally joined with said button and forwardly extending through said second flush hole in said inner wall of said housing to the end thereof; the diameter of the second flush hole being larger than that of said push rod;

a stop valve having a first and second end, said stop valve having a diameter larger than that of said second flush hole, said first end of said stop valve mounted at one end of said push rod, said second end of said stop valve conforming to the sides of said second flush hole;

a sealing gasket provided about the said second end said stop valve;

whereby when said button is pushed, said push rod will push said stop valve away from said second flush hole to thereby open said second passage until said manual button is released;

an automatic flush device including:

an electromagnetic actuated valve assembly mounted on external side of said housing, said assembly including:

a valve stem vertically mounted in said electromagnetic valve, said valve stem having a lower portion;

a first spring for biasing said valve stem whereby said biased valve stem extends through said bore into said housing;

said valve assembly adapted to be controlled by an infra red emitting-and-detecting control device mounted outside of said housing, a infra red control device having means for emitting an infra red ray and detecting said ray as reflected from a human body and having, after a predetermined first time, means for actuating said electromagnetic valve to open said first passage and after a predetermined second time to close said first passage, a pressure sensing film having a central level portion, a pressure releasing hole at the center of said central level portion and a ring flange about said central level portion, with at least one pressure balancing hole provided in said ring flange, the diameter of said at least one pressure balancing hole being smaller than that of said pressure releasing hole, said pressure releasing hole mounted and positioned below said valve stem so that the underside of said lower portion of said valve stem is butts against said pressure releasing hole, the assembly of said pressure sensing film and said valve stem dividing space within said first passage into an upper chamber and a lower chamber, each chamber being adapted to receive, contain and release water, said central level portion of said pressure sensing film tightly covering said first flush hole, whereby when said electromagnetic valve is actuated by said control device said valve stem is moved to open said pressure releasing hole, the water filled in said upper chamber will rapidly drain out through said pressure releasing hole and said pressure sensing film will be expanded by the water pressure in said lower chamber to open said first passage until said electromagnetic valve is deactivated by said control device.

2. A flushing apparatus according to claim 1, wherein a sealing gasket is provided about said valve stem on the side thereof normally adjoining said pressure releasing hole of said pressure sensing film.

* * * * *